US005671669A

United States Patent [19]

Okuda et al.

[11] Patent Number: 5,671,669

[45] Date of Patent: Sep. 30, 1997

[54] STENCIL CONVEYING MEANS ADAPTED TO CONVEY A STENCIL SHEET PARALLEL TO THE AXIS OF A PRINTING DRUM

[75] Inventors: Sadanao Okuda; Makoto Ishikawa; Takao Kawabe; Masakazu Kawano, all of Tokyo, Japan

[73] Assignee: Riso Kagaku Corporation, Tokyo, Japan

[21] Appl. No.: 543,937

[22] Filed: Oct. 17, 1995

[30] Foreign Application Priority Data

Oct. 24, 1994 [JP] Japan ..... 6-258249

[51] Int. Cl.[6] ..... B41L 13/06

[52] U.S. Cl. ..... 101/116; 101/128.1

[58] Field of Search ..... 101/116, 117, 101/118, 127, 128.1, 128.21, 128.4, 477

[56] References Cited

FOREIGN PATENT DOCUMENTS

| | | | |
|---|---|---|---|
| 16787 | 1/1984 | Japan | 101/128.21 |
| 16789 | 1/1984 | Japan | 101/128.21 |
| 16788 | 1/1984 | Japan | 101/128.21 |
| 2202186 | 9/1988 | United Kingdom | 101/128.21 |
| 2267060 | 11/1993 | United Kingdom . | |

*Primary Examiner*—Stephen R. Funk

*Attorney, Agent, or Firm*—Kanesaka & Takeuchi

[57] ABSTRACT

A stencil printing machine having a stencil sheet composed of a resin film and a substrate and curled in one direction is formed of a perforating section for perforating the stencil sheet; a printing drum wrapped around with the stencil sheet perforated at the perforating section, and driven to rotate about the axis thereof; a conveying device for conveying the stencil sheet to the printing drum in such a manner that an edge of the stencil sheet perforated at the perforating section is substantially in parallel with one linear line of the printing drum; a clamp device for clamping the edge of the stencil sheet conveyed by the conveying device to the printing drum, on the printing drum along one linear line of the printing drum; and a stencil discharge section for removing the stencil sheet from the printing drum after printing.

4 Claims, 6 Drawing Sheets

FIG. 5

| | Outer side of roll | Core side of roll |
|---|---|---|
| Wrapping performance in stencil printing machine of one embodiment | 0/50 sheets | 0/50 sheets |
| Wrapping performance in prior art stencil printing machine | 2/50 sheets | 6/50 sheets |
| Discharging performance in stencil printing machine of one embodiment | 0/50 sheets | 0/50 sheets |
| Discharging performance in prior art stencil printing machine | 3/50 sheets | 8/50 sheets |

FIG. 6

| Rounding quality | Outer side of roll | Core side of roll |
|---|---|---|
| Longitudinal direction | 2.21 | 3.51 |
| Transverse direction | 0.02 | 0 |

STENCIL CONVEYING MEANS ADAPTED TO CONVEY A STENCIL SHEET PARALLEL TO THE AXIS OF A PRINTING DRUM

BACKGROUND OF THE INVENTION

The present invention relates to a stencil printing machine which has high performance of wrapping a stencil sheet for stencil printing around a printing drum and discharging a used stencil sheet to a stencil discharge section.

A stencil sheet to be used in a stencil printing machine is generally of such a construction that a substrate for backing a resin film is cemented with an adhesive to the resin film. That is, the stencil sheet is produced generally by cementing a long, continuous belt-like substrate to a long, continuous belt-like resin film as disclosed for example in Japanese Patent Laid-Open No. Hei 5-309968. The cementing of the substrate to the resin film is done with a fixed tension applied in the longitudinal direction to the resin film and the substrate. The tension of either of the resin film and the substrate must be changed according to its extensibility (modulus in tension); the stencil sheet thus produced is likely to curl longitudinally after cementing.

Most stencil sheets are of a roll type. The roll-type stencil sheet is generally of the cylindrical type that a long belt-like stencil sheet is wound on a core tube. The long belt-like stencil sheet wound on the core tube in the shape of a roll will get curled with the lapse of time. The curling occurs in the longitudinal direction of the stencil sheet. In order to decrease curling as much as possible it is a general practice to increase the core tube diameter. Thus increasing the core tube diameter, however, will increase the overall volume of the roll of a stencil sheet and accordingly will require the use of a larger-size stencil printing machine itself which holds the roll inside.

FIG. 4 shows a part of the constitution of a prior art stencil printing machine. In the stencil printing machine, a roll of the stencil sheet S and a printing drum 100 are arranged parallelly. The long belt-like stencil sheet paid out from the roll of the stencil sheet S is, after perforation, held by a clamp means 101 along a transverse direction (direction of width) intersecting with the direction of unwinding, then being fixed on the peripheral surface of the printing drum 100.

The long belt-like stencil sheet S wound in a roll shape is clamped by the clamp means 101 along the direction of width intersecting at right angles with the longitudinal direction of a curled sheet, and is secured on the printing drum 100 along a linear line on the printing drum 100 parallel to the axis of the printing drum 100. Therefore, the operation of wrapping and removing the stencil sheet S in relation to the printing drum 100 is largely affected by the longitudinal curl. In case of a large curl, the clamp means 101 sometimes fails to hold the stencil sheet S as indicated by an imaginary line in FIG. 4, failing in wrapping the stencil sheet around the printing drum 100. Also the stencil sheet S after printing, when removed from the printing drum 100 and conveyed to a stencil discharge section 102, is greatly affected by the longitudinal curl, resulting in a failure in taking up the stencil sheet by a discharge roller 103 of the stencil discharge section 102.

To overcome the above-described drawbacks of the prior art, the present invention has an object to provide the stencil printing machine that facilitates wrapping the perforated stencil sheet around a printing drum and removing a used stencil sheet from the printing drum and discharging it into a stencil discharge section.

SUMMARY OF THE INVENTION

The stencil printing machine according to the first aspect of the present invention comprises a stencil sheet composed of a resin film and a substrate and curled in a specific direction; a perforating section for perforating the stencil sheet; a printing drum wrapped with the stencil sheet perforated at the perforating section, and driven to rotate about the axis of itself; a conveying means for carrying the stencil sheet to the printing drum in such a manner that the edge in the specific direction of the stencil sheet perforated at the perforating section will be substantially parallel to one linear line on the printing drum; a clamp means for fastening, along the one linear line on the printing drum, the edge of the stencil sheet that has been carried by the conveying means to the printing drum; and the stencil sheet discharge section for removing the stencil sheet from the printing drum after completion of printing.

The stencil printing machine according to the second aspect of the present invention is characterized in that, in the stencil printing machine of the first aspect, the axis of the stencil sheet wound in a cylindrical shape intersects at right angles with the axis of the printing drum.

The stencil printing machine according to the third aspect of the present invention is characterized in that, in the stencil printing machine of the first aspect, a reinforcing member is mounted along the specific direction in a part other than a printing area of the stencil sheet, and is fixed by the clamp means on the printing drum.

The stencil sheet perforated at the perforating section is fixed by the clamp means on the printing drum in such a manner that the specific direction in which the stencil sheet curls largely will be along the linear line on the printing drum. The stencil sheet can be securely clamped by the clamp means because of the presence of little curling of the stencil sheet in the circumferential direction of the printing drum. After printing, the stencil sheet is removed from the printing drum by means of the stencil discharge section. Since the stencil sheet curls little in the circumferential direction of the printing drum, the stencil discharge section can properly hold the edge of the stencil sheet.

These and other features, objects and advantages of the present invention will become more obvious from the following description when taken in connection with the accompanying drawings.

BRIEF DESCRIPTION OF THE DRAWINGS

FIG. 5 is a table giving a result of evaluation of performance of wrapping the stencil sheet around the printing drum and discharging the stencil sheet from the printing drum between the stencil printing machine of the present embodiment and a prior art stencil printing machine; and FIG. 6 is a table giving a result of measurements of a curling quality of the stencil sheet.

DETAILED DESCRIPTION OF THE PREFERRED EMBODIMENTS

Figure 1:
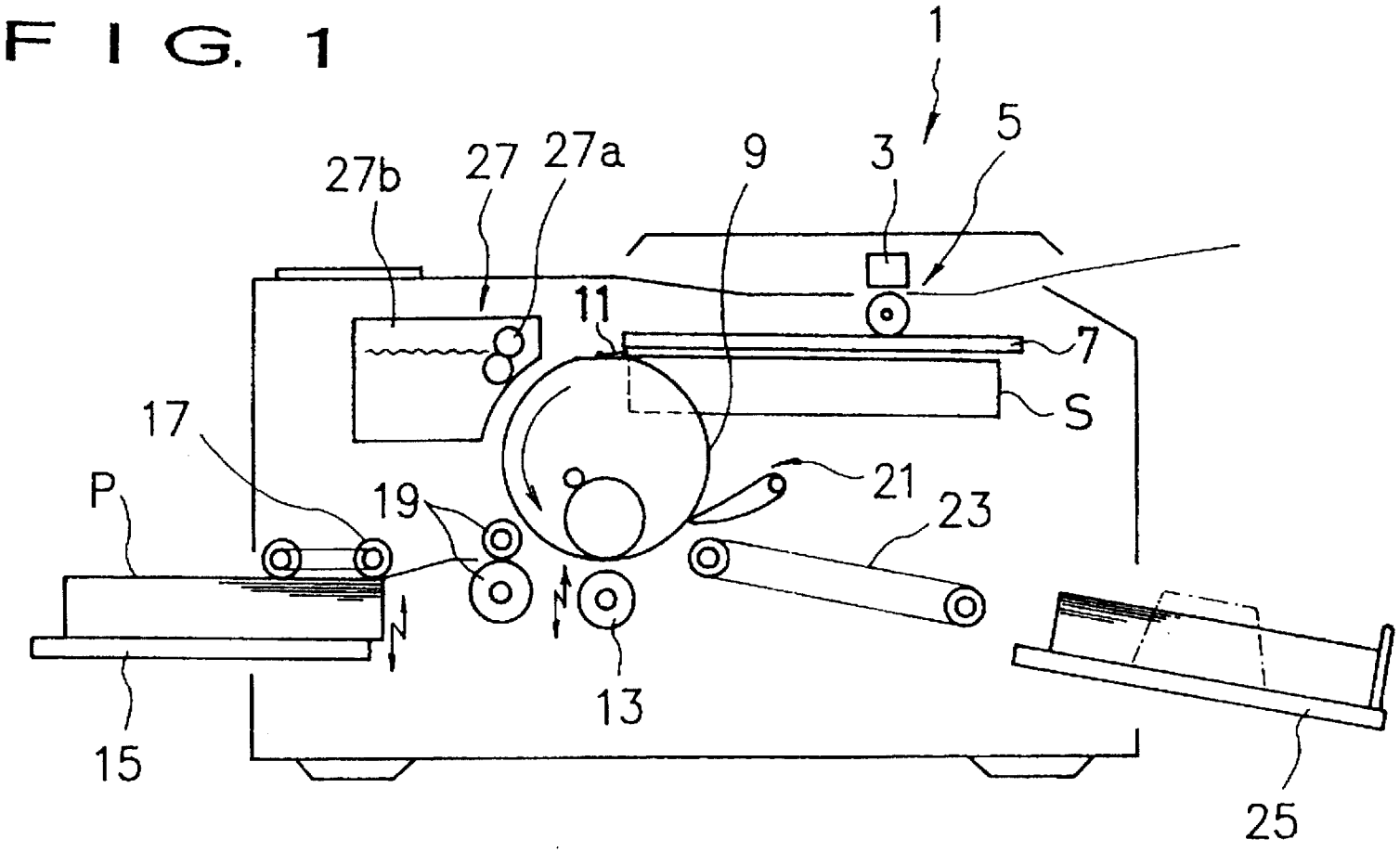
FIG. 1 is a sectional view showing the construction of one embodiment of a stencil printing machine 1.

One embodiment of the present invention will be explained with reference to FIGS. 1 to 3. FIG. 1 is a schematic view showing one embodiment of a stencil printing machine 1. An original image reading section 5 including an image scanner 3 functions to read an original image to be printed and outputs the image as an original image data. A perforating section 7 includes a perforating device for forming a perforated image in a stencil sheet S in accordance with the original image data thus read by the original image reading section 5. As the perforating device a thermal head is usable.

The stencil sheet S perforated at the perforating section 7 has been wrapped around a printing drum 9 having an ink-previous peripheral wall. The printing drum 9 is driven about the axis of itself by means of a driving means not shown. In the printing drum 9 is provided an ink feeding means for feeding ink to the inner peripheral surface of the printing drum 9. On the outer peripheral surface of the printing drum 9 is provided a clamp means 11. The clamp means 11 is used to clamp one end of the stencil sheet S along one linear line on the cylindrical printing drum 9 parallel to the axis there.

Beneath the printing drum 9 an impression member 13 is mounted. The impression member 13 is a rotatable roller which moves up and down in synchronization with the rotation of the printing drum 9. The impression member 13 serves to hold, in cooperation with the printing drum 9, a printed paper P that has been carried simultaneously with the rotation of the printing drum 9, then printing is done by transferring ink from the printing drum 9 to the paper P to be printed.

The printing paper P on the paper feed table 15 is separated one by one by means of a paper separating roller 17, and is fed between the printing drum 9 and the impression member 13 by means of a paper feed timing roller 19 simultaneously with printing operation. A separating claw 21 provided in the vicinity of the printing drum 9 separates the printed paper P pressed against the printing drum 9 by the impression member 13, from the outer peripheral surface of the printing drum 9. The printed paper P stripped from the printing drum 9 by means of the separating claw 21 is discharged to a delivery table 25 by a belt conveyor mechanism of the conveyor apparatus 23.

A stencil discharge section 27 disposed near the printing drum 9 has a stencil discharge roller 27*a* which strips the used stencil sheet S from the outer peripheral surface of the printing drum 9 while holding one end thereof, and a box-shaped storing section 27*b* for storing the stencil sheet S removed from the stencil discharge roller 27*a*.

The stencil sheet S used in the present embodiment is a stencil sheet S of a roll type that a long belt-like stencil sheet is wound in a cylindrical form. The stencil sheet S has a curl caused by winding in a longitudinal direction and a curl caused by the stencil sheet structure that the substrate and the resin film are cemented.

Figure 2:
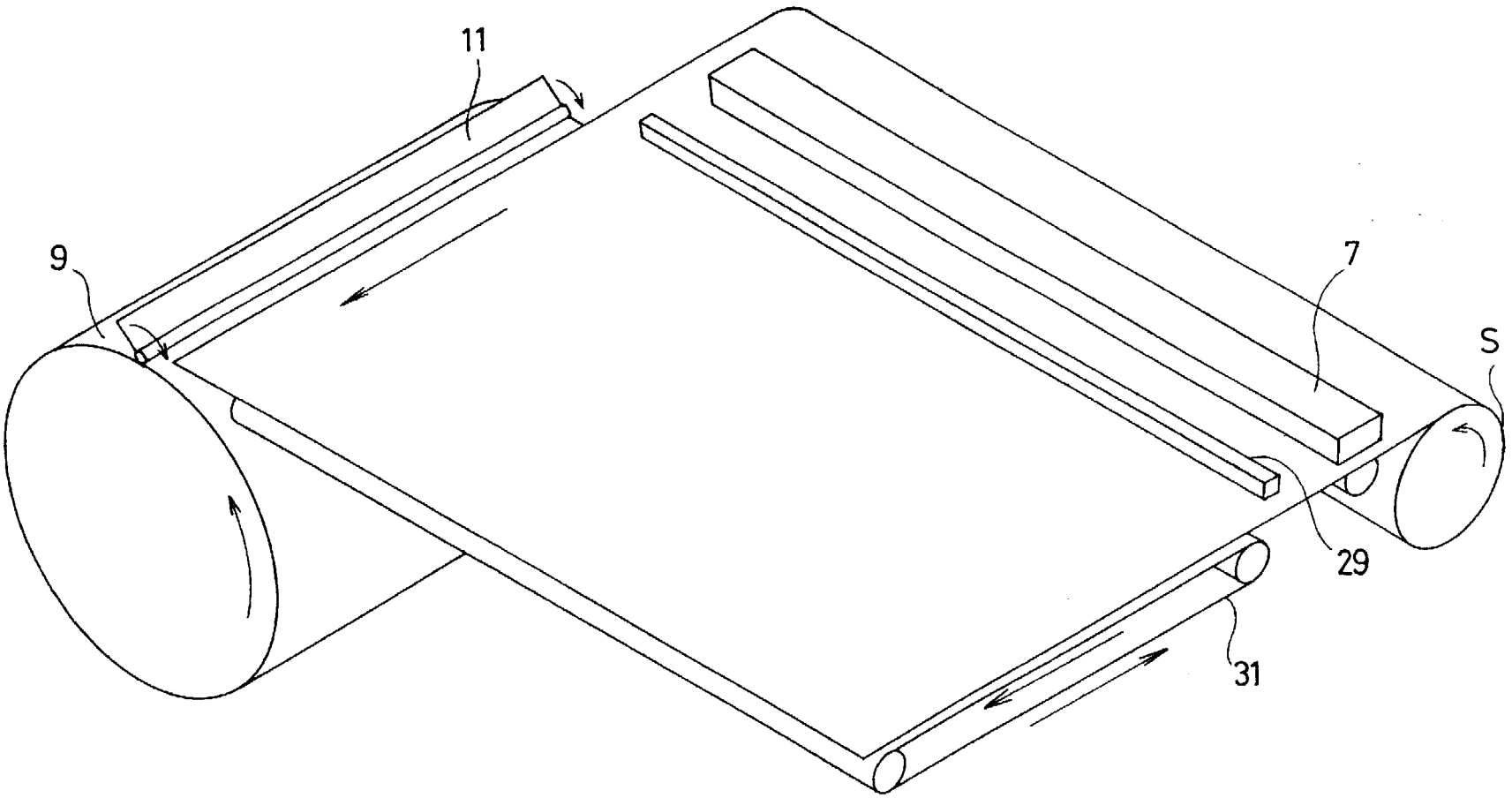
FIG. 2 is a perspective view showing a stencil sheet wrapping mechanism in the one embodiment of the stencil printing machine 1 and function thereof.
Figure 3:
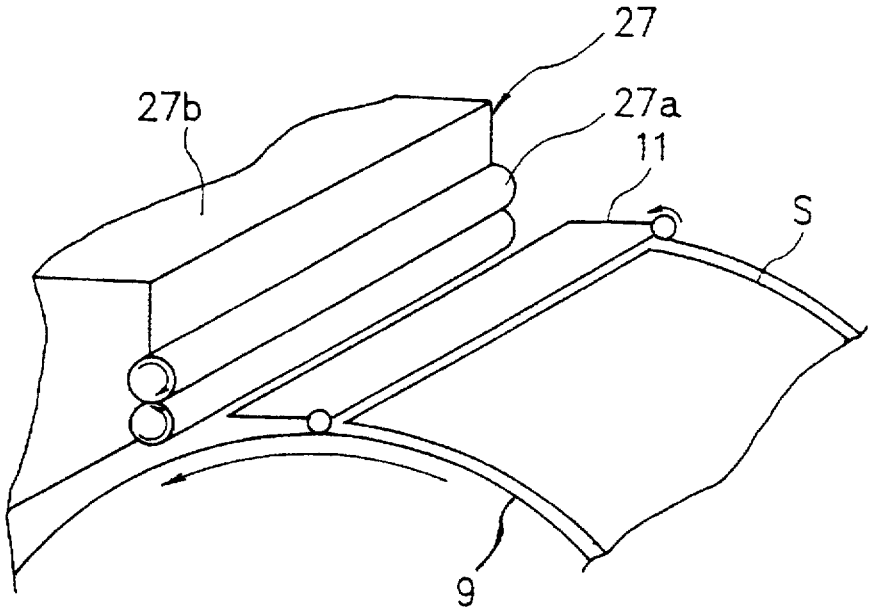
FIG. 3 is a perspective view showing the stencil discharge mechanism in the one embodiment of the stencil printing machine 1 and function thereof.

As shown in FIGS. 1 and 2, the stencil sheet S of a roll type is arranged approximately horizontally so that its axis will meet at right angles with the axis of the printing drum 9 and its one end will be disposed in the vicinity of the top section of the printing drum 9. The printing sheet S is loaded near the printing drum 9 so that the inner side of a rolled stencil sheet will face the peripheral surface of the printing drum when fed out toward the printing drum 9.

There is mounted a cutter unit 29 adjacently to the perforating section 7. The stencil sheet S perforated at the perforating section 7 comes to the cutter unit 29, whereby the stencil sheet S is cut along the transverse direction (direction of width).

Above the printing drum 9, there is arranged a conveyor belt 31 as a conveying means in a position ahead of the cutter unit 29 in the direction the stencil sheet S is paid out.

The roll of the stencil sheet S, as shown in FIG. 2, is fed out along the direction of the axis of the printing drum 9, and is perforated at the perforating section 7. The stencil sheet S, when perforated, is conveyed on the conveyor belt 31 at a speed exactly corresponding to the perforating operation of the perforating section 7.

After perforation, the long belt-like stencil sheet S reaches a specific position, where the cutter unit 29 cuts the stencil sheet S along the transverse direction (direction of width). The stencil sheet S thus cut to an appropriate length is secured by the clamp means 11 on the printing drum 9 along its longitudinal direction. Then, the printing drum 9 rotates in a specific direction indicated in FIGS. 1 and 2, wrapping the stencil sheet S around the peripheral surface thereof.

After printing, the stencil sheet is discharged. As shown in FIG. 3, first the clamp means 11 releases the stencil sheet S, and then the printing drum 9 rotates in an illustrated direction. The leading edge of the stencil sheet S thus released approaches the stencil discharge roller 27*a* of the stencil discharge section The stencil discharge roller 27*a* is rotated to strip the used stencil sheet S from the peripheral surface of the printing drum 9, discharging the stencil sheet S into the storing section 27*b* of the stencil discharge section According to the stencil printing machine 1 of the present embodiment, the edge in the longitudinal direction of a curled stencil sheet S is secured by the clamp means 11 along one linear line on the printing drum 9. Therefore, the transverse direction (direction of width) in which the stencil sheet S is less curled agrees with the direction of rotation (circumferential direction) of the printing drum 9. Thus the clamp means 11 can securely clamp one end of the stencil sheet S on the printing drum 9.

Particularly in the case of the roll-type stencil sheet S, the stencil sheet S has a curl in the area close to the core tube side, resulting in a specially heavy curling in the longitudinal direction. According to the stencil sheet S of the present embodiment, the stencil sheet S can be fixed exactly in a specific position on the printing drum 9.

If the stencil sheet S is heavily curled, the clamp means will sometimes fail to clamp the stencil sheets; according to the stencil printing machine 1 of the present embodiment such a failure in clamping will not occur.

When the stencil sheet is discharged, one end of the stencil sheet on the printing drum 9 is moved to the stencil discharge roller 27*a* of the stencil discharge section 27. At this time, the curled stencil sheet S will not be taken up by the stencil discharge roller 27*a*; that is, a discharge error will occur. However, according to the stencil printing machine 1 of the present embodiment, the stencil discharge roller 27*a* can exactly receive one end of the stencil sheet S because of little curling of the stencil sheet S on the printing drum 9, and can exactly strip the used stencil sheet S from the printing drum 9 and discard it.

Figure 4:
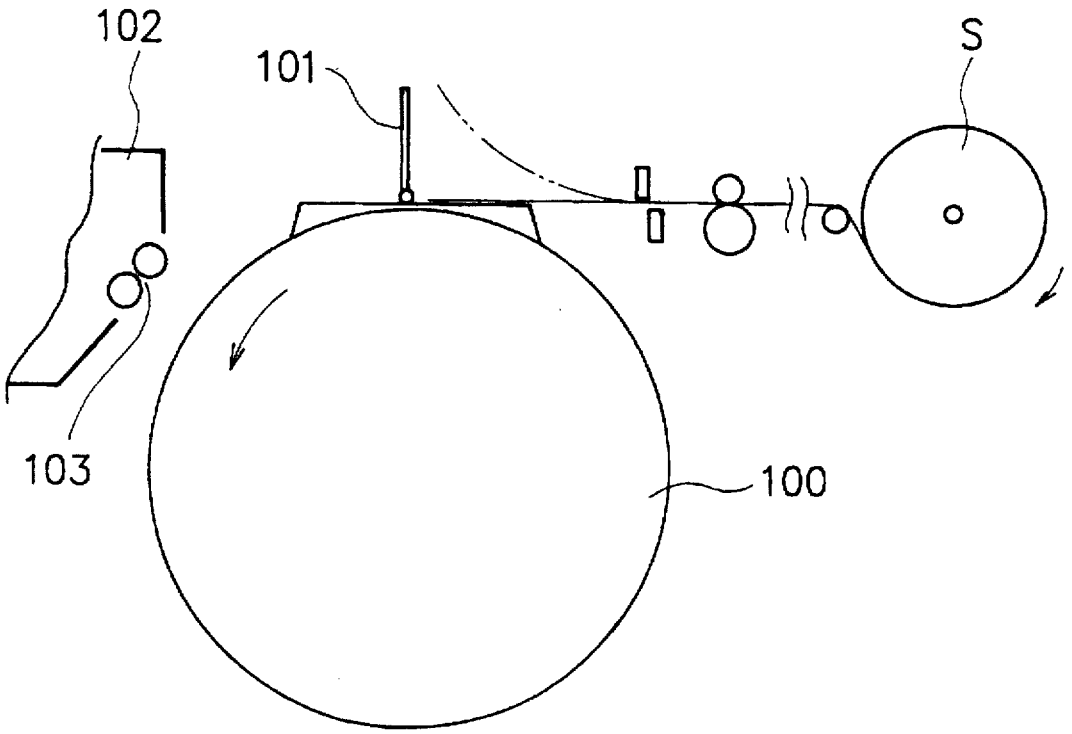
FIG. 4 is a sectional view showing one part of the construction of a prior art stencil printing machine.

Evaluation was conducted on the performance of wrapping the stencil sheet around the printing drum and the performance of discharging the stencil sheet from the printing drum for comparison between the stencil printing machine 1 of the present embodiment and a prior art stencil printing machine explained by referring to FIG. 4. The stencil sheet wrapping performance was evaluated on 50 sheets taken from the outer side of a stencil sheet roll where the stencil sheet is relatively little curled, and on another 50 sheets taken from the core side of the same roll where the stencil sheet is relatively heavily curled. The number of stencil sheets that could not be fixed on the printing drum is given as an evaluation result. The stencil sheet discharging performance was also evaluated on 50 sheets taken from both outer and core sides of the stencil sheet roll as in the case of the wrapping performance evaluation stated above. In this case also the number of stencil sheets that could not be stripped and taken into the stencil discharge section is given as the evaluation result. The results are given in FIG. 5. In this table, the smaller the numerator of a fraction, the higher performance of wrapping and discharging the stencil sheet.

The stencil S used in the stencil printing machine 1 explained above is of a roll type; it should be noticed, however, that stencil sheets are also applicable to the stencil printing machine 1 of the present invention. In the case of the sheet-type stencil S, it is sufficient only to secure, by the clamp means 11 along the linear line on the printing drum 9, one longitudinal edge of the stencil sheet at the time of manufacture.

Next, the stencil sheet to be used in the present embodiment of the present invention will be explained. The resin film of the stencil sheet S used in the present invention is a film of a thermoplastic resin which can be perforated by the use of a heat source such as a thermal head. The thermoplastic resin may be for example polyethylene, polypropylene, polyvinyl chloride, polyvinylidene chloride, polyester, polystyrene, polyurethane, polycarbonate, acrylic resin, and silicone resin, of which polyvinylidene chloride and polyester are specially desirable. It is also possible to use a resin film perforable by melting through an ink-jet system other than the heat source such as the thermal head.

For the substrate of the stencil sheet S of the present invention, thin paper, resin sheet, printing paper, etc. are usable.

Evaluation was made on the curled state of the stencil sheet by testing a curling quality R in both longitudinal and transverse directions. The curling quality R is given by the following equation.

$$R=100/r$$

where r is a curling radius in millimeter.

The above equation indicates that the smaller the value of the curling quality R, the smaller the degree of curling. When the curling quality R=0, the stencil sheet is entirely free from curling. A stencil sheet having a smaller curling quality R can be stably wrapped around, and stripped from, the printing drum in the stencil printing machine of the present invention or a prior art machine.

The curling quality R is measured by the following procedure. A stencil sheet is pasted on a 40 mm by 40 mm frame with the resin film side up in such a manner that the longitudinal and transverse directions of the stencil sheet will be in parallel with each side of the frame. After the pasting operation, the frame and the stencil sheet are cut along the diagonal line of the frame. At this time, the radius of a curl appearing along the cut line of the stencil sheet is measured as the curling quality R. The same measurement was conducted on the outside and core side of winding of the stencil sheet. A result of the measurement is shown in FIG. 6.

The stencil sheet is thus sharply curled along the longitudinal direction thereof. Accordingly, the performance of wrapping and discharging the stencil sheet in relation to the cylindrical printing drum can be improved by restricting the curling of the stencil sheet with a reinforcing member mounted along the longitudinal direction other than the printed surface of the stencil sheet. For the reinforcing member a member having enough specific rigidity to restrict the curling of the stencil sheet is usable. For example paper and synthetic resin film can be used. The reinforcing member is applicable to restraining the curling of either of the roll-type and thin-paper stencil sheets. The stencil sheet with such a reinforcing member secured with the clamp means in the stencil printing machine 1 of the present embodiment is hardly subject to curling on the printing drum 9 and is further improved in the performance of wrapping and discharging the stencil sheet on the cylindrical printing drum of the stencil printing machine 1.

According to the stencil printing machine stated in the first and second aspects, the stencil sheet, which is secured on the printing drum by a clamp means along the longitudinal direction in which the stencil sheet heavily curls, will be little subject to curling on the printing drum, thereby improving the wrapping and discharging performance of the stencil sheet.

According to the stencil printing machine stated in the third aspect, since the reinforcing member attached along the longitudinal direction of the stencil sheet in other than the printing surface is fixed on the printing drum by the clamp means, more excellent stencil sheet wrapping and discharging performances than in the stencil printing machine stated in the first and second aspects are obtainable.

What is claimed is:

1. A stencil printing machine for printing by means of a stencil sheet, said stencil printing machine comprising:

a perforating section for perforating said stencil sheet;

a printing drum adapted to receive said stencil sheet wrapped there around, said printing drum being rotated about an axis thereof;

conveying means adapted to convey said stencil sheet to said printing drum in such a manner that a longitudinal edge of said stencil sheet perforated at said perforating section is substantially parallel to the axis of said printing drum;

clamp means for clamping said edge of said stencil sheet conveyed by said conveying means to said printing drum; and a stencil sheet discharge section for removing said stencil sheet from said printing drum after printing.

2. A stencil printing machine according to claim 1, wherein an axis of a supply roll of said stencil sheet intersects at right angles with the axis of said printing drum.

3. A stencil printing machine according to claim 1, further comprising means for driving the printing drum attached to the printing drum for rotating the same.

4. A stencil printing machine according to claim 1, further comprising said stencil sheet composed of a resin film and a substrate and curled relative to a longitudinal direction of the stencil sheet.

* * * * *